US010227537B2

(12) United States Patent
Lai et al.

(10) Patent No.: US 10,227,537 B2
(45) Date of Patent: Mar. 12, 2019

(54) METHOD OF HYDROTREATMENT OF FISCHER-TROPSCH SYNTHESIS PRODUCTS

(71) Applicant: WUHAN KAIDI ENGINEERING TECHNOLOGY RESEARCH INSTITUTE CO., LTD., Wuhan (CN)

(72) Inventors: Bo Lai, Wuhan (CN); Youliang Shi, Wuhan (CN); Li Xu, Wuhan (CN)

(73) Assignee: WUHAN KAIDI ENGINEERING TECHNOLOGY RESEARCH INSTITUTE CO., LTD., Wuhan (CN)

( * ) Notice: Subject to any disclaimer, the term of this patent is extended or adjusted under 35 U.S.C. 154(b) by 0 days.

(21) Appl. No.: 15/673,439

(22) Filed: Aug. 10, 2017

(65) Prior Publication Data

US 2017/0335208 A1 Nov. 23, 2017

Related U.S. Application Data

(63) Continuation-in-part of application No. PCT/CN2016/073024, filed on Feb. 1, 2016.

(30) Foreign Application Priority Data

Feb. 11, 2015 (CN) ..... 2015 1 0071747

(51) Int. Cl.
*C10G 65/12* (2006.01)
*C10G 67/02* (2006.01)

(52) U.S. Cl.
CPC ..... *C10G 67/02* (2013.01); *C10G 65/12* (2013.01); *C10G 2300/1022* (2013.01); *C10G 2300/1055* (2013.01); *C10G 2400/04* (2013.01)

(58) Field of Classification Search
CPC ..... C10G 65/02; C10G 2400/04; C10G 2300/1022; C10G 2400/02; C10G 2400/16
See application file for complete search history.

(56) References Cited

U.S. PATENT DOCUMENTS 4,943,672 A * 7/1990 Hamner ..... C10G 45/62 208/112
2004/0159582 A1* 8/2004 Simmons ..... C10G 65/043 208/89

* cited by examiner

*Primary Examiner* — Randy Boyer
*Assistant Examiner* — Juan C Valencia
(74) *Attorney, Agent, or Firm* — Matthias Scholl P.C.; Matthias Scholl

(57) ABSTRACT

A method of hydrotreatment of Fischer-Tropsch synthesis products, the method including: 1) mixing Fischer-Tropsch wax with a sulfur-containing liquid additive, contacting a resulting mixture with hydrogen, feeding a hydrogen-containing mixture to a first reaction region, feeding an effluent from the first reaction region to a second reaction region, and carrying out hydrocracking reaction; 2) feeding a hydrocracking product from the second reaction region and Fischer-Tropsch naphtha and diesel fuel to a third reaction region, carrying out hydrofining reaction; feeding an effluent from the hydrofining reaction to a fourth reaction region, and carrying out hydroisomerizing pour-point depression reaction; and 3) feeding an effluent from the fourth reaction region to a gas-liquid separation system to yield hydrogen-rich gas and liquid products, recycling the hydrogen-rich gas, and feeding the liquid products to a distilling system.

18 Claims, 1 Drawing Sheet

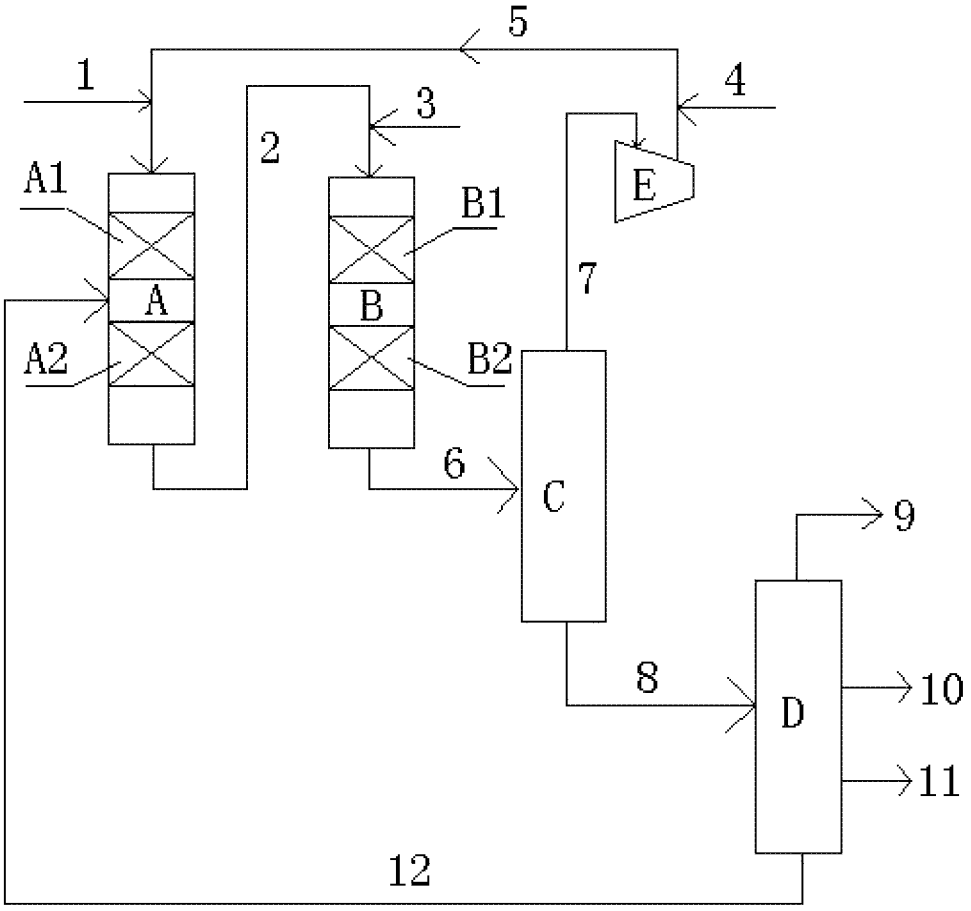
5
1
4
3
2
A1
B1
E
7
A
B
A2
B2
6
C
9
8
D
10
11
12

METHOD OF HYDROTREATMENT OF FISCHER-TROPSCH SYNTHESIS PRODUCTS

CROSS-REFERENCE TO RELATED APPLICATIONS

This application is a continuation-in-part of International Patent Application No. PCT/CN2016/073024 with an international filing date of Feb. 1, 2016, designating the United States, now pending, and further claims foreign priority to Chinese Patent Application No. 201510071747.0 filed Feb. 11, 2015. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, and Cambridge, Mass. 02142.

BACKGROUND OF THE INVENTION

Field of the Invention

The present disclosure relates to a method of hydrotreatment of low-temperature Fischer-Tropsch synthesis products.

Description of the Related Art

Low-temperature Fischer-Tropsch synthesis products are rich in straight-chain paraffins, have high pour point and low density, and thus cannot directly be used to produce high quality diesel fuel.

Typical treatment processes of low-temperature Fischer-Tropsch synthesis products include hydrocracking, hydrofining, and hydrodewaxing. In the hydrocracking process, the involved catalysts tend to coke and deactivate. The entire t hydrocracking process is long, complex, requires a large amount of investment, and the produced diesel fuel is of relatively low density, and therefore, cannot be used as vehicle fuel.

SUMMARY OF THE INVENTION

In view of the above-described problems, it is one objective of the invention to provide a method of hydrotreatment of low-temperature Fischer-Tropsch synthesis products to yield low pour point synthetic diesel fuel; the hydrotreatment method features a simple process and low energy consumption, and the synthesized diesel fuel has relatively high density.

To achieve the above objective, in accordance with one embodiment of the invention, there is provided a method of hydrotreatment of low-temperature Fischer-Tropsch synthesis products, the method comprising:

1) mixing Fischer-Tropsch wax with a sulfur-containing liquid additive at a certain proportion, contacting a resulting mixture with hydrogen, feeding a hydrogen-containing mixture to a first reaction region comprising a hydrogenation pretreatment catalyst, feeding an effluent from the first reaction region to a second reaction region comprising a hydrocracking catalyst, and carrying out hydrocracking reaction;
2) feeding a hydrocracking product from the second reaction region and Fischer-Tropsch naphtha and diesel fuel to a third reaction region comprising a hydrofining catalyst, carrying out hydrofining reaction; feeding an effluent from the hydrofining reaction to a fourth reaction region comprising a hydroisomerizing pour-point depressant catalyst, and carrying out hydroisomerizing pour-point depression reaction; and
3) feeding an effluent from the fourth reaction region to a gas-liquid separation system C to yield hydrogen-rich gas and liquid products, recycling the hydrogen-rich gas, feeding the liquid products to a distilling system D, to yield naphtha, diesel fuel and tail oil, and returning the tail oil to the second reaction region.

In a class of this embodiment, the sulfur-containing liquid additive in 1) is inferior catalytic cracking diesel fuel or coking diesel fuel; and the sulfur-containing liquid additive accounts for 20-50 wt. % of a total weight of the sulfur-containing liquid additive and the Fischer-Tropsch wax.

In a class of this embodiment, in 1), the hydrogenation pretreatment is carried out under the following conditions: a reaction temperature is at 300-370° C.; a hydrogen partial pressure is 4.0-10 MPa; a volume velocity is 0.5-2.0 $h^{-1}$; and a volume ratio of hydrogen to oil is 500-1500.

In a class of this embodiment, in 1), the hydrocracking reaction is carried out under the following conditions: a reaction temperature is at 330-410° C.; a hydrogen partial pressure is 4.0-10 MPa; a volume velocity is 0.4-6.0 $h^{-1}$; and a volume ratio of hydrogen to oil is 600-1500.

In a class of this embodiment, in 2), the hydrofining reaction is carried out under the following conditions: a reaction temperature is at 280-340° C.; a hydrogen partial pressure is 4.0-10 MPa; a volume velocity is 0.4-6.0 $h^{-1}$; and a volume ratio of hydrogen to oil is 500-1200.

In a class of this embodiment, in 2), the hydroisomerizing pour-point depression reaction is carried out under the following conditions: a reaction temperature is at 280-400° C.; a hydrogen partial pressure is 4.0-10 MPa; a volume velocity is 0.4-6.0 $h^{-1}$; and a volume ratio of hydrogen to oil is 400-1200.

In a class of this embodiment, the hydrogenation pretreatment or hydrofining catalyst comprises a carrier selected from aluminum oxide or silicon-containing aluminum oxide and a hydrogenation active metal loaded on the carrier; the hydrogenation active metal comprises at least two active ingredients of non-noble metals of VIB and/or VIII family; and the content of active metal oxides is 25-40 wt. % of a total weight of the catalyst.

In a class of this embodiment, the hydrocracking catalyst comprises an acidic material as a carrier selected from amorphous silica-alumina, molecular sieve, or a mixture thereof, and a hydrogenation active metal which is a combination of a VIB-family metal element selected from molybdenum (Mo) and Tungsten (W) and a VIII-family metal element selected from cobalt (Co), Nickle (Ni), platinum (Pt) and palladium (Pd). The content of active metal oxides is 25-40 wt. % of a total weight of the catalyst.

In a class of this embodiment, the carrier of the hydrocracking catalyst is a combination of amorphous silica-alumina and one or more selected from a Y-type molecular sieve, a β molecular sieve, a ZSM molecular sieve and an SAPO molecular sieve; and the hydrogenation active metal is a combination of W—Ni, Mo—Ni or Mo—Co.

In a class of this embodiment, the tail oil separated in 3) is recycled completely or partially to the second reaction region for hydrocracking.

Advantages of the method of hydrotreatment of low-temperature Fischer-Tropsch synthesis products of the invention are as follow: on the basis of characteristics of Fischer-Tropsch synthesis products, the method employs appropriate catalysts to synthesize diesel fuel with relatively high density; and because the hydrofining, hydrocracking and isomerizing catalysts are non-noble metal catalysts, reducing the production costs. Further, the Fischer-Tropsch light ingredients also contain a certain amount of olefin and a little oxygen-contained compound which may generate a plenty of heat if it is subjected to individual hydrofining and lead to coking and inactivation of the catalyst easily due to excessive local heat release of the catalyst; and the excessive heat release may also lead to rapid temperature rise of the catalyst bed and bad for controlling the temperature of the bed; therefore, a plenty of cold hydrogen shall be injected in order to control the temperature. The Fischer-Tropsch wax containing a little unsaturated olefin is subjected to hydrogenation pretreatment and hydrocracking in the invention; the effluent plays a role of storing heat, thereby offering heat and hydrogen-rich gas to the hydrofining reaction and generating a "hot trap" of heat for the hydrofining. As a result, it is good for controlling the temperature of the catalyst bed, reduces the quench cooling hydrogen required by a hydrofining section greatly and reduces energy consumption. Through the method, the density of the synthetic diesel fuel is improved, the pour point is lowered, and the synthetic diesel fuel achieves the indexes of diesel fuel for vehicle.

BRIEF DESCRIPTION OF THE DRAWINGS

The invention is described hereinbelow with reference to accompanying drawings, in which the sole FIGURE is a method of hydrotreatment of low-temperature Fischer-Tropsch synthesis products according to one embodiment of the invention.

DETAILED DESCRIPTION OF THE EMBODIMENTS

To further illustrate the invention, experiments detailing a method of hydrotreatment of low-temperature Fischer-Tropsch synthesis products are described below. It should be noted that the following examples are intended to describe and not to limit the invention.

As shown in the sole FIGURE, a first reactor A comprises a first reaction region A1 and a second reaction region A2 in longitudinal direction; a hydrogenation pretreatment catalyst is placed on a bed of the first reaction region A1, and a hydrocracking catalyst is placed on the bed of the second reaction bed A2; and rich hydrogen is fed inward through a pipe 5 from a top of the first reactor A. 1) Fischer-Tropsch wax and a sulfur-containing liquid additive are mixed and then mingled with the rich hydrogen after entering into the first reactor A through a pipe 1; a mixture is subjected to hydrogenation pretreatment in the first reaction region A1 first, and the reaction effluent enters into the second reaction region A2 to carry out hydrocracking.

2) A second reactor B comprises a third reaction region B1 and a fourth reaction region B2 in longitudinal direction; and a hydrofining catalyst is placed on the bed of the third reaction region B1, and the hydrocracking catalyst is placed on the bed of the fourth reaction bed B2.

3) A cracked product from the second reaction region A2 is mixed with Fischer-Tropsch light ingredients (Fischer-Tropsch diesel fuel and naphtha) through a pipe 2 and fed into the third reaction region B1 of the second reactor B through a pipe 3 for hydrofining reaction; the product after refining enters the fourth reaction region to carry out a hydroisomerizing pour point depressant reaction. The product after pour point depressant reaction enters into a gas-liquid separator C through a pipe 6, the gas phase ingredients (mainly referring to hydrogen and containing sulfureted hydrogen at the same time) enters into a circulating compressor E through a pipe 7; the hydrogen-rich gas after compression is mixed with the new hydrogen of a pipe 4 and are fed inward from the top of the first reactor A through a pipe 5. Liquid phase ingredients enter into a fractioning system D through a pipe 8 for fractioning to acquire dry gas 9, naphtha 10, diesel fuel 11 and tail oil 12. Furthermore, the tail oil 12 is recycled completely or partially to the second reaction region A2 in the first reactor A for recycle cracking.

The sulfur-containing liquid additive in the step 1) is inferior catalytic cracking diesel fuel and coking diesel fuel; and the sulfur-containing liquid additive accounts for 10-65 wt. % of a total weight of the sulfur-containing liquid additive and the Fischer-Tropsch wax, particularly, 20-50 wt. %.

In 1), the hydrogenation pretreatment is carried out under the following conditions: a reaction temperature is at 280-390° C.; a hydrogen partial pressure is 2.0-15 MPa; a volume velocity is 0.4-6.0 $h^{-1}$; and a volume ratio of hydrogen to oil is 300-2000.

Preferably, the hydrogenation pretreatment is carried out under the following conditions: a reaction temperature is at 300-370° C.; a hydrogen partial pressure is 4.0-10 MPa; a volume velocity is 0.5-2.0 $h^{-1}$; and a volume ratio of hydrogen to oil is 500-1500.

In 1), the hydrocracking reaction is carried out under the following conditions: a reaction temperature is at 300-450° C.; a hydrogen partial pressure is 2.0-15 MPa; a volume velocity is 0.4-6.0 $h^{-1}$; and a volume ratio of hydrogen to oil is 300-2000.

Preferably, in 1), the hydrocracking reaction is carried out under the following conditions: a reaction temperature is at 330-410° C.; a hydrogen partial pressure is 4.0-10 MPa; a volume velocity is 0.4-6.0 $h^{-1}$; and a volume ratio of hydrogen to oil is 600-1500.

In 2), the hydrofining reaction is carried out under the following conditions: a reaction temperature is at 250-380° C.; a hydrogen partial pressure is 2.0-15 MPa; a volume velocity is 0.4-6.0 $h^{-1}$; and a volume ratio of hydrogen to oil is 300-2000. Preferably, the hydrofining reaction is carried out under the following conditions: a reaction temperature is at 280-340° C.; a hydrogen partial pressure is 4.0-10 MPa; a volume velocity is 0.4-6.0 $h^{-1}$; and a volume ratio of hydrogen to oil is 500-1200.

In 2), the hydroisomerizing pour-point depression reaction is carried out under the following conditions: a reaction temperature is at 250-450° C.; a hydrogen partial pressure is 2.0-15 MPa; a volume velocity is 0.4-6.0 $h^{-1}$; and a volume ratio of hydrogen to oil is 300-2000. Preferably, the hydroisomerizing pour-point depression reaction is carried out under the following conditions: a reaction temperature is at 280-400° C.; a hydrogen partial pressure is 4.0-10 MPa; a volume velocity is 0.4-6.0 $h^{-1}$; and a volume ratio of hydrogen to oil is 400-1200.

The hydrogenation pretreatment or hydrofining catalyst comprises a carrier selected from aluminum oxide or silicon-containing aluminum oxide and a hydrogenation active metal loaded on the carrier; the hydrogenation active metal comprises at least two active ingredients of non-noble metals of VIB and/or VIII family; and the content of active metal oxides is 10-50 wt. % of a total weight of the catalyst, preferably, 25-40 wt. %.

The hydrocracking catalyst comprises an acidic material as a carrier selected from amorphous silica-alumina, molecular sieve, or a mixture thereof, and a hydrogenation active metal which is a combination of a VIB-family metal element selected from molybdenum (Mo) and Tungsten (W) and a VIII-family metal element selected from cobalt (Co), Nickle (Ni), platinum (Pt) and palladium (Pd). The content of active metal oxides is 10-50 wt. % of a total weight of the catalyst, preferably, 25-40 wt. %.

The acidity center of the hydrocracking catalyst has two functions: cracking and isomerization, and its carrier can be one or more selected from a Y-type molecular sieve, a β molecular sieve, a ZSM molecular sieve and an SAPO molecular sieve. Furthermore, the hydrocracking catalyst also contains the amorphous silica-alumina.

The tail oil separated in 3) can be recycled completely or partially to the second reaction region for hydrocracking.

The hydrocracking catalyst used in the method of the invention can also be existing commercial hydrofining catalysts.

A hydroisomerizing pour-point depressant catalyst used in 2) can be existing commercial hydroisomerizing pour-point depressant catalysts.

In the invention, the sulfur-containing liquid additive comprises the inferior catalytic cracking diesel fuel or coking diesel fuel.

To further explain the key points of the invention, the following further explains the invention in connection with the specific embodiment; however, the invention is not limited to the embodiment below.

Example 1

Low-temperature Fischer-Tropsch wax was mixed with a sulfur-containing liquid additive comprising inferior catalytic cracking diesel fuel in accordance with a certain proportion by weight. The inferior catalytic cracking diesel fuel accounted for 25% of the total weight of the mixture. The properties of the low-temperature Fischer-Tropsch wax and the liquid additive comprising inferior catalytic cracking diesel fuel are listed in Table 1. The mixed raw material was fed to a first reactor A to mix with the hydrogen-rich gas, and the mixture was subjected to hydrogenation pretreatment in the first reaction region A1 first, and then the hydrocracking reaction was carried out in the second reaction region A2; the products obtained from the hydrocracking reaction were fed to the third reaction region B1 of the second reactor B with the Fischer-Tropsch diesel fuel and naphtha (see Table 1 for properties of Fischer-Tropsch diesel fuel) to carry out hydrofining reaction; the products obtained from the hydrofining reaction were fed to the fourth reaction region B2 for hydroisomerizing pour-point depression reaction; the products obtained from the reaction were fractionated using a fractioning system to yield a diesel fuel fraction No. 1. See Table 2 for properties of the diesel fuel fraction No. 1.

Reaction conditions of the hydrogenation pretreatment: the reaction temperature was 350° C., the reaction pressure was 6.0 Mpa, liquid hourly space velocity (LHSV) was 1.0 $h^{-1}$, and the volume ratio of hydrogen to oil was 1000. The conditions of hydrocracking: the reaction temperature was at 380° C., the reaction pressure was 6.0 Mpa, LHSV was 1.5 $h^{-1}$, and the volume ratio of hydrogen to oil was 1000. The conditions of the hydrofining: the reaction temperature was 310° C., the reaction pressure was 6.0 Mpa, LHSV was 3.0 $h^{-1}$, and the volume ratio of hydrogen to oil was 1000. The conditions of the hydroisomerizing pour-point depression: the reaction temperature was at 350° C., the reaction pressure was 6.0 Mpa, LHSV was 3.0 $h^{-1}$, and the volume ratio of hydrogen to oil was 1000.

Example 2

The example employs the same mixed raw material as that in Example 1, and the mixed raw material was fed to a first reactor A to mix with the hydrogen-rich gas, and the mixture was subjected to hydrogenation pretreatment in the first reaction region A1 first, and then the hydrocracking reaction was carried out in the second reaction region A2; the products obtained from the hydrocracking reaction were fed to the third reaction region B1 of the second reactor B with the Fischer-Tropsch diesel fuel and naphtha (see Table 1 for properties of Fischer-Tropsch diesel fuel) to carry out hydrofining reaction; the products obtained from the hydrofining reaction were fed to the fourth reaction region B2 for hydroisomerizing pour-point depression reaction; the products obtained from the reaction were fractionated using a fractioning system to yield a diesel fuel fraction No. 2. See Table 2 for properties of the diesel fuel fraction No. 2.

Reaction conditions of the hydrogenation pretreatment: the reaction temperature was 360° C., the reaction pressure was 8.0 Mpa, liquid hourly space velocity (LHSV) was 1.5 $h^{-1}$, and the volume ratio of hydrogen to oil was 1200. The conditions of hydrocracking: the reaction temperature was at 390° C., the reaction pressure was 8.0 Mpa, LHSV was 2.0 $h^{-1}$, and the volume ratio of hydrogen to oil was 1200. The conditions of the hydrofining: the reaction temperature was 330° C., the reaction pressure was 8.0 Mpa, LHSV was 4.0 $h^{-1}$, and the volume ratio of hydrogen to oil was 1200. The conditions of the hydroisomerizing pour-point depression: the reaction temperature was at 360° C., the reaction pressure was 8.0 Mpa, LHSV was 3.0 $h^{-1}$, and the volume ratio of hydrogen to oil was 1200.

Example 3

Low-temperature Fischer-Tropsch wax was mixed with a sulfur-containing liquid additive comprising inferior catalytic cracking diesel fuel in accordance with a certain proportion by weight. The inferior catalytic cracking diesel fuel accounted for 40% of the total weight of the mixture. The mixed raw material was fed to a first reactor A to mix with the hydrogen-rich gas, and the mixture was subjected to hydrogenation pretreatment in the first reaction region A1 first, and then the hydrocracking reaction was carried out in the second reaction region A2; the products obtained from the hydrocracking reaction were fed to the third reaction region B1 of the second reactor B with the Fischer-Tropsch diesel fuel and naphtha (see Table 1 for properties of Fischer-Tropsch diesel fuel) to carry out hydrofining reaction; the products obtained from the hydrofining reaction were fed to the fourth reaction region B2 for hydroisomerizing pour-point depression reaction; the products obtained from the reaction were fractionated using a fractioning system to yield a diesel fuel fraction No. 3. See Table 2 for properties of the diesel fuel fraction No. 3.

Reaction conditions of the hydrogenation pretreatment: the reaction temperature was 365° C., the reaction pressure was 8.0 Mpa, liquid hourly space velocity (LHSV) was 1.5 $h^{-1}$, and the volume ratio of hydrogen to oil was 1200. The conditions of hydrocracking: the reaction temperature was at 380° C., the reaction pressure was 8.0 Mpa, LHSV was 2.0 $h^{-1}$, and the volume ratio of hydrogen to oil was 1200. The conditions of the hydrofining: the reaction temperature was 330° C., the reaction pressure was 8.0 Mpa, LHSV was 4.0 $h^{-1}$, and the volume ratio of hydrogen to oil was 1200. The conditions of the hydroisomerizing pour-point depression:

the reaction temperature was at 360° C., the reaction pressure was 8.0 Mpa, LHSV was 4.0 $h^{-1}$, and the volume ratio of hydrogen to oil was 1200.

Example 4

Low-temperature Fischer-Tropsch wax was mixed with a sulfur-containing liquid additive comprising inferior coking diesel fuel in accordance with a certain proportion by weight. The inferior coking diesel fuel accounted for 40% of the total weight of the mixture. The properties of the liquid additive comprising inferior coking diesel fuel are listed in Table 1. The mixed raw material was fed to a first reactor A to mix with the hydrogen-rich gas, and the mixture was subjected to hydrogenation pretreatment in the first reaction region A1 first, and then the hydrocracking reaction was carried out in the second reaction region A2; the products obtained from the hydrocracking reaction were fed to the third reaction region B1 of the second reactor B with the Fischer-Tropsch diesel fuel and naphtha (see Table 1 for properties of Fischer-Tropsch diesel fuel) to carry out hydrofining reaction; the products obtained from the hydrofining reaction were fed to the fourth reaction region B2 for hydroisomerizing pour-point depression reaction; the products obtained from the reaction were fractionated using a fractioning system to yield a diesel fuel fraction No. 4. See Table 2 for properties of the diesel fuel fraction No. 4.

Reaction conditions of the hydrogenation pretreatment: the reaction temperature was 365° C., the reaction pressure was 8.0 Mpa, liquid hourly space velocity (LHSV) was 1.5 $h^{-1}$, and the volume ratio of hydrogen to oil was 1200. The conditions of hydrocracking: the reaction temperature was at 380° C., the reaction pressure was 8.0 Mpa, LHSV was 2.0 $h^{-1}$, and the volume ratio of hydrogen to oil was 1200. The conditions of the hydrofining: the reaction temperature was 330° C., the reaction pressure was 8.0 Mpa, LHSV was 4.0 $h^{-1}$, and the volume ratio of hydrogen to oil was 1200. The conditions of the hydroisomerizing pour-point depression: the reaction temperature was at 360° C., the reaction pressure was 8.0 Mpa, LHSV was 4.0 $h^{-1}$, and the volume ratio of hydrogen to oil was 1200.

Comparison Example 1

Low-temperature Fischer-Tropsch wax was fed to a first reactor A to mix with the hydrogen-rich gas, and the mixture was subjected to hydrogenation pretreatment in the first reaction region A1 first, and then the hydrocracking reaction was carried out in the second reaction region A2; the products obtained from the hydrocracking reaction were fed to the third reaction region B1 of the second reactor B with the Fischer-Tropsch diesel fuel and naphtha (see Table 1 for properties of Fischer-Tropsch diesel fuel) to carry out hydrofining reaction; the products obtained from the hydrofining reaction were fed to the fourth reaction region B2 for hydroisomerizing pour-point depression reaction; the products obtained from the reaction were fractionated using a fractioning system to yield a diesel fuel fraction No. 5. See Table 2 for properties of the diesel fuel fraction No. 5.

Reaction conditions of the hydrogenation pretreatment: the reaction temperature was 330° C., the reaction pressure was 8.0 Mpa, liquid hourly space velocity (LHSV) was 1.5 $h^{-1}$, and the volume ratio of hydrogen to oil was 1000. The conditions of hydrocracking: the reaction temperature was at 400° C., the reaction pressure was 8.0 Mpa, LHSV was 1.5 $h^{-1}$, and the volume ratio of hydrogen to oil was 1000. The conditions of the hydrofining: the reaction temperature was 330° C., the reaction pressure was 8.0 Mpa, LHSV was 3.0 $h^{-1}$, and the volume ratio of hydrogen to oil was 1000. The conditions of the hydroisomerizing pour-point depression: the reaction temperature was at 360° C., the reaction pressure was 8.0 Mpa, LHSV was 3.0 $h^{-1}$, and the volume ratio of hydrogen to oil was 1000.

TABLE 1

Properties of Fischer-Tropsch wax, diesel fuel, and liquid additives

| Properties | Fischer-Tropsch wax | Fischer-Tropsch diesel fuel | Inferior catalytic cracking diesel fuel | Inferior coking diesel fuel |
|---|---|---|---|---|
| Density (20° C.)/g/cm$^3$ | 0.7967 | 0.7621 | 0.8962 | 0.8373 |
| distillation range/° C. | 217-740 | 138-328 | 184-360 | 203-345 |
| Sulphur/μg/g | — | — | 7000 | 5000 |
| Nitrogen/μg/g | — | — | 882 | 1212 |
| Pour point/° C. | — | 25 | −8 | −11 |
| Cetane number | — | 69.8 | 33.9 | 49 |

TABLE 2

Properties of products

| Properties of products | Example 1 Diesel fuel No. 1 | Example 2 Diesel fuel No. 2 | Example 3 Diesel fuel No. 3 | Example 4 Diesel fuel No. 4 | Comparison example 1 Diesel fuel No. 5 |
|---|---|---|---|---|---|
| Density (20° C.)/g/cm$^3$ | 0.8243 | 0.8211 | 0.8325 | 0.8200 | 0.7413 |
| Sulphur/μg/g | <10.0 | <10.0 | <10.0 | <10.0 | <1.0 |
| Pour point/° C. | −25 | −31 | −35 | −36 | 2 |
| Cetane number | 55 | 54 | 53 | 58 | 61 |

From Table 2, when the liquid additive is doped at certain proportion through the method of the invention, the density of the diesel fuel fraction acquired through transformation from the low-temperature Fischer-Tropsch synthesis product is greater than 0.82 g/cm$^3$, its sulfur content is less than 10.0 μg/g, and its cetane number is greater than 51, thereby meeting the indexes of Euro V standard. Further, through the method of the invention, the pour point of the acquired diesel fuel is below 0° C. which can meet the requirements of low-temperature flow property of diesel fuel in a low-temperature area. However, if the Fischer-Tropsch wax is subjected to hydrocracking independently, for example at proportion 1, the density of the acquired diesel fuel is 0.7413 g/cm$^3$ only, the density thereof cannot achieve the indexes of diesel fuel for vehicle, and the pour point thereof is at 2° C. only which cannot meet the requirements of low-temperature diesel fuel in the low-temperature area.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method of hydrotreatment of Fischer-Tropsch synthesis products, the method comprising:

1) mixing Fischer-Tropsch wax with a sulfur-containing liquid additive, contacting a resulting mixture with hydrogen, feeding a hydrogen-containing mixture to a first reaction region comprising a hydrogenation pretreatment catalyst, feeding an effluent from the first reaction region to a second reaction region comprising a hydrocracking catalyst, and carrying out hydrocracking reaction;

2) feeding a hydrocracking product from the second reaction region and Fischer-Tropsch naphtha and diesel fuel to a third reaction region comprising a hydrofining catalyst, carrying out hydrofining reaction; feeding an effluent from the hydrofining reaction to a fourth reaction region comprising a hydroisomerizing pour-point depressant catalyst, and carrying out hydroisomerizing pour-point depression reaction; and 3) feeding an effluent from the fourth reaction region to a gas-liquid separation system C to yield hydrogen-rich gas and liquid products, recycling the hydrogen-rich gas, feeding the liquid products to a distilling system D, to yield naphtha, diesel fuel and tail oil, and returning the tail oil to the second reaction region.

2. The method of claim 1, wherein the sulfur-containing liquid additive in 1) is inferior catalytic cracking diesel fuel or coking diesel fuel; and the sulfur-containing liquid additive accounts for 20-50 wt. % of a total weight of the sulfur-containing liquid additive and the Fischer-Tropsch wax.

3. The method of claim 1, wherein in 1), the hydrogenation pretreatment is carried out under the following conditions: a reaction temperature is at 300-370° C.; a hydrogen partial pressure is 4.0-10 MPa; a volume velocity is 0.5-2.0 $h^{-1}$; and a volume ratio of hydrogen to oil is 500-1500.

4. The method of claim 2, wherein in 1), the hydrogenation pretreatment is carried out under the following conditions: a reaction temperature is at 300-370° C.; a hydrogen partial pressure is 4.0-10 MPa; a volume velocity is 0.5-2.0 $h^{-1}$; and a volume ratio of hydrogen to oil is 500-1500.

5. The method of claim 1, wherein in 1), the hydrocracking reaction is carried out under the following conditions: a reaction temperature is at 330-410° C.; a hydrogen partial pressure is 4.0-10 MPa; a volume velocity is 0.4-6.0 $h^{-1}$; and a volume ratio of hydrogen to oil is 600-1500.

6. The method of claim 2, wherein in 1), the hydrocracking reaction is carried out under the following conditions: a reaction temperature is at 330-410° C.; a hydrogen partial pressure is 4.0-10 MPa; a volume velocity is 0.4-6.0 $h^{-1}$; and a volume ratio of hydrogen to oil is 600-1500.

7. The method of claim 1, wherein in 2), the hydrofining reaction is carried out under the following conditions: a reaction temperature is at 280-340° C.; a hydrogen partial pressure is 4.0-10 MPa; a volume velocity is 0.4-6.0 $h^{-1}$; and a volume ratio of hydrogen to oil is 500-1200.

8. The method of claim 2, wherein in 2), the hydrofining reaction is carried out under the following conditions: a reaction temperature is at 280-340° C.; a hydrogen partial pressure is 4.0-10 MPa; a volume velocity is 0.4-6.0 $h^{-1}$; and a volume ratio of hydrogen to oil is 500-1200.

9. The method of claim 1, wherein in 2), the hydroisomerizing pour-point depression reaction is carried out under the following conditions: a reaction temperature is at 280-400° C.; a hydrogen partial pressure is 4.0-10 MPa; a volume velocity is 0.4-6.0 $h^{-1}$; and a volume ratio of hydrogen to oil is 400-1200.

10. The method of claim 2, wherein in 2), the hydroisomerizing pour-point depression reaction is carried out under the following conditions: a reaction temperature is at 280-400° C.; a hydrogen partial pressure is 4.0-10 MPa; a volume velocity is 0.4-6.0 $h^{-1}$; and a volume ratio of hydrogen to oil is 400-1200.

11. The method of claim 1, wherein the hydrogenation pretreatment or hydrofining catalyst comprises a carrier selected from aluminum oxide or silicon-containing aluminum oxide and a hydrogenation active metal loaded on the carrier; the hydrogenation active metal comprises at least two active ingredients of non-noble metals of VIB and/or VIII family; and a content of active metal oxides is 25-40 wt. % of a total weight of the hydrogenation pretreatment or hydrofining catalyst.

12. The method of claim 2, wherein the hydrogenation pretreatment or hydrofining catalyst comprises a carrier selected from aluminum oxide or silicon-containing aluminum oxide and a hydrogenation active metal loaded on the carrier; the hydrogenation active metal comprises at least two active ingredients of non-noble metals of VIB and/or VIII family; and a content of active metal oxides is 25-40 wt. % of a total weight of the hydrogenation pretreatment or hydrofining catalyst.

13. The method of claim 1, wherein the hydrocracking catalyst comprises an acidic material as a carrier selected from amorphous silica-alumina, molecular sieve, or a mixture thereof, and a hydrogenation active metal which is a combination of a VIB-family metal element selected from molybdenum (Mo) and Tungsten (W) and a VIII-family metal element selected from cobalt (Co), Nickle (Ni), platinum (Pt) and palladium (Pd); and a content of active metal oxides is 25-40 wt. % of a total weight of the hydrocracking catalyst.

14. The method of claim 2, wherein the hydrocracking catalyst comprises an acidic material as a carrier selected from amorphous silica-alumina, molecular sieve, or a mixture thereof, and a hydrogenation active metal which is a combination of a VIB-family metal element selected from molybdenum (Mo) and Tungsten (W) and a VIII-family metal element selected from cobalt (Co), Nickle (Ni), platinum (Pt) and palladium (Pd); and a content of active metal oxides is 25-40 wt. % of a total weight of the hydrocracking catalyst.

15. The method of claim 13, wherein the carrier of the hydrocracking catalyst is a combination of amorphous silica-alumina and one or more selected from a Y-type molecular sieve, a β molecular sieve, a ZSM molecular sieve and an SAPO molecular sieve; and the hydrogenation active metal is a combination of W—Ni, Mo—Ni or Mo—Co.

16. The method of claim 14, wherein the carrier of the hydrocracking catalyst is a combination of amorphous silica-alumina and one or more selected from a Y-type molecular sieve, a β molecular sieve, a ZSM molecular sieve and an SAPO molecular sieve; and the hydrogenation active metal is a combination of W—Ni, Mo—Ni or Mo—Co.

17. The method of claim 1, wherein the tail oil separated in 3) is recycled completely or partially to the second reaction region for hydrocracking.

18. The method of claim 2, wherein the tail oil separated in 3) is recycled completely or partially to the second reaction region for hydrocracking.

* * * * *